US005318287A

United States Patent [19]

Okayama

[11] Patent Number: 5,318,287

[45] Date of Patent: Jun. 7, 1994

[54] BYPASS SHEET FEEDING DEVICE

[75] Inventor: Kenichi Okayama, Tokyo, Japan

[73] Assignee: Konica Corporation, Tokyo, Japan

[21] Appl. No.: 932,338

[22] Filed: Aug. 19, 1992

[30] Foreign Application Priority Data

Sep. 11, 1991 [JP] Japan ..... 3-231896

[51] Int. Cl.[5] ..... B65H 5/00

[52] U.S. Cl. ..... 271/10; 271/119; 271/121; 271/245

[58] Field of Search ..... 271/9, 119, 121, 124, 271/125, 10, 245, 122

[56] References Cited

U.S. PATENT DOCUMENTS

| | | | |
|---|---|---|---|
| 5,129,642 | 7/1992 | Svyatsky et al. | 271/124 |
| 5,172,900 | 12/1992 | Uno et al. | 271/125 |

FOREIGN PATENT DOCUMENTS

| | | | |
|---|---|---|---|
| 55-165837 | 12/1980 | Japan . | |
| 57-27842 | 2/1982 | Japan . | |
| 58-2146 | 1/1983 | Japan . | |
| 166446 | 7/1986 | Japan | 271/125 |
| 282237 | 12/1986 | Japan | 271/119 |
| 191337 | 8/1987 | Japan | 271/119 |
| 37042 | 2/1988 | Japan | 271/119 |
| 37044 | 2/1988 | Japan | 271/119 |
| 63-37044 | 2/1988 | Japan . | |
| 82252 | 4/1988 | Japan | 271/119 |
| 98536 | 4/1989 | Japan | 271/119 |
| 1-44613 | 9/1989 | Japan . | |
| 236128 | 9/1989 | Japan | 271/119 |
| 294133 | 11/1989 | Japan | 271/119 |
| 102035 | 4/1991 | Japan | 271/119 |

*Primary Examiner*—Skaggs H. Grant

*Attorney, Agent, or Firm*—Frishauf, Holtz, Goodman & Woodward

[57] ABSTRACT

A bypass sheet feeding device including a sheet separation device composed of a semicircular sheet drive roller and a multi-feed prevention roller which is coupled to a torque limiter, is provided on a sheet bypass feeding unit. When an uppermost sheet of sheets stacked on a bypass sheet feed tray is fed by a feed roller, the circumferential surface of the drive roller comes into press contact with the multi-feed prevention roller, thereby the uppermost sheet only is separated and conveyed and at least a sheet below the uppermost sheet is prevented from being fed. After separation and conveyance of the uppermost sheet is completed, the drive roller is stopped at a position where the circumferential surface is located upward, which results in releasing press contact with the multi-feed prevention roller.

11 Claims, 3 Drawing Sheets

BYPASS SHEET FEEDING DEVICE

BACKGROUND OF THE INVENTION

The present invention relates to a sheet feeding device provided in a recording device of an electrophotographic copier, and more particularly relates to a manual sheet feeding device to feed transfer sheets made of various materials.

Transfer sheets used for image recording in an electrophotographic copier are usually accommodated in a sheet cassette detachably provided to the copier, and are then automatically fed.

The uppermost transfer sheet stacked on the sheet cassette is fed to an image forming section by the action of a semicircular roller and a separation claw in the prior art. The transfer sheets on the sheet cassette are fed one by one in the aforementioned manner.

In the case of manual feeding by which transparent sheets and thick sheets such as postcards are fed, the aforementioned separation claw can not be used, so that the following methods are used: a method by which transfer sheets are separated one by one by the action of a circular drive roller and a separation roller which comes into press contact with the circular drive roller and is connected with a torque limiter; and a method by which transfer sheets are separated one by one by the action of a circular drive roller and a friction pad which is brought into pressure contact with the circular drive roller.

However, in the case where the aforementioned methods are applied, the sheet separation device including the circular drive roller and the separation roller or the friction pad, pinches a transfer sheet even after a separating operation has been completed.

In order to release a transfer sheet from the transfer sheet separation device immediately after the completion of a separating operation, a semicircular roller of the prior art is well known. In this case, the semicircular roller is used as a separation roller together with a separation claw. The aforementioned technique is disclosed in Japanese Patent Application Open to Public Inspection No. 165837/1980.

According to Japanese Patent Application Open to Public Inspection No. 2146/1983, the object of the semicircular roller is to increase the conveyance force with respect to thin papers, and it can not be expected that the semicircular roller functions as a separation roller.

Accordingly, a strong conveyance force is required for a paper feeding roller for use in registration which is disposed downstream of the drive roller, so that a paper feeding roller of a simple registration system utilizing a shutter, can not be adopted, and accordingly the costs are increased.

Further, the following problem is caused. That is, when a transfer sheet is released from the drive roller after image formation has been started on the leading edge of the transfer sheet, the transfer sheet is jolted. As a result, slippage is caused in the transferred image.

SUMMARY OF THE INVENTION

It is a primary object of the present invention to provide a sheet feeding device in which a simple registration system including a sheet feeding roller and a shutter is utilized.

The first embodiment of the the sheet feeding device of the present invention comprises a transfer sheet separation device including a semicircular drive roller and a separation roller which is brought into pressure contact with the semicircular drive roller. The second embodiment of the sheet feeding device of the present invention comprises a transfer sheet separation device including a semicircular drive roller and a friction pad which is brought into pressure contact with the semicircular drive roller.

BRIEF DESCRIPTION OF THE DRAWINGS

FIG. 3(*b*) is a view showing the structure of an essential portion of the sheet feeding device of another example of the second invention.

DETAILED DESCRIPTION OF THE PREFERRED EMBODIMENTS

Figure 1:
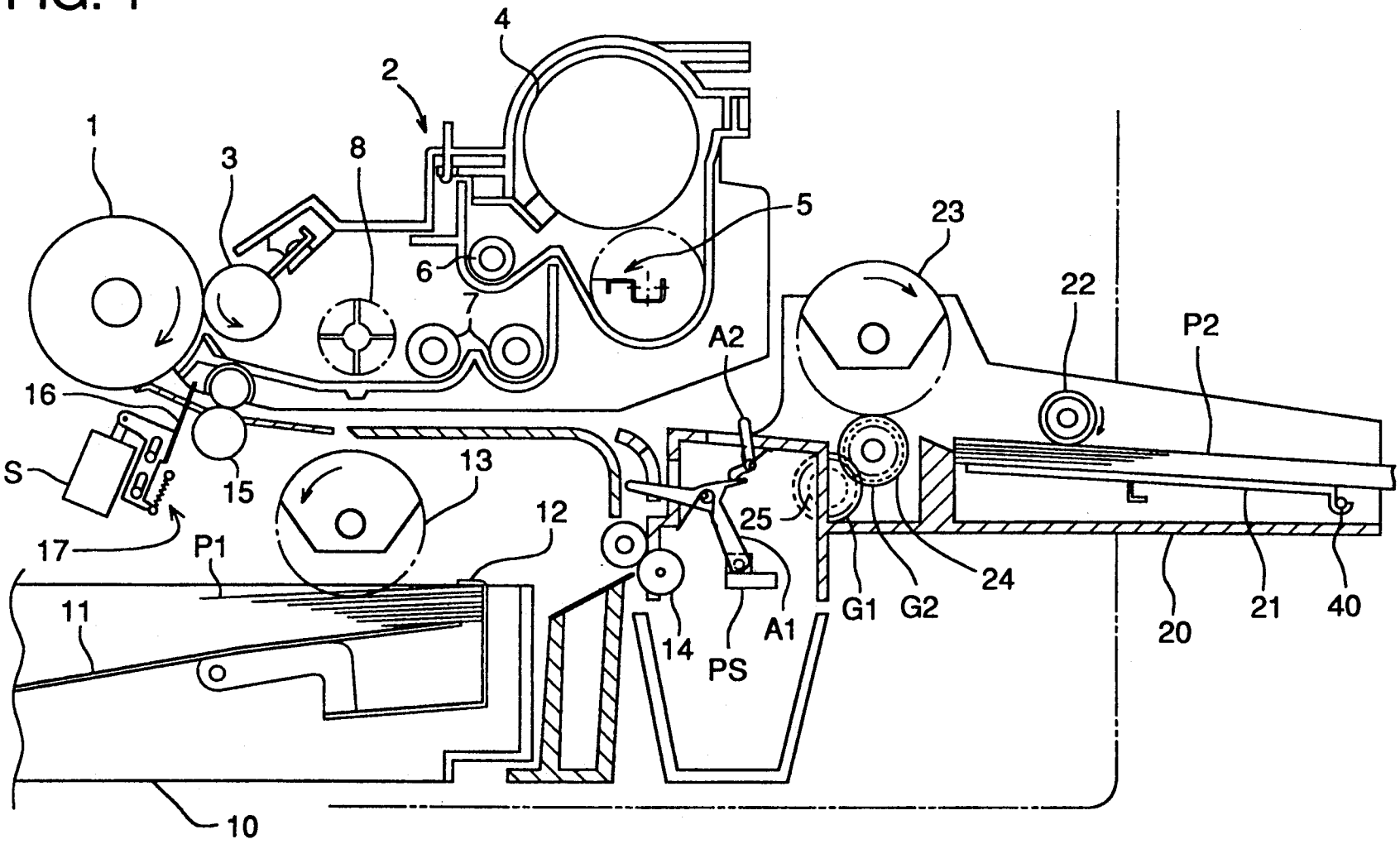
FIG. 1 is a sectional view showing the structure of the sheet feeding device of the first invention.

An example of the first embodiment is shown in FIG. 1.

FIG. 1 is a sectional view showing the structure of a transfer sheet feeding device in an image forming apparatus. Numeral 1 is a photoreceptor drum, numeral 2 is a developing unit, numeral 3 is a developing sleeve, and numeral 4 is a toner cartridge. Toner is supplied to the developing unit 2 from the toner cartridge 4 through conveyance members 5 and 6. Further, toner is supplied to the developing sleeve 3 through stirring members 7 and 8, so that an electrostatic latent image formed on the circumferential surface of the photoreceptor drum 1 can be developed.

Numeral 10 is a sheet feeding cassette, numeral 11 is an intermediate plate, and numeral 12 is a separation claw. Transfer sheets P1 to be automatically fed, are maintained at a position shown in the drawing in the following manner: transfer sheets P1 are stacked on the intermediate plate 11; under the condition that both edge portions of transfer sheets P1 are pressed by the weight of the separation claw 12, the intermediate plate 11 is pushed upwardly; and transfer sheets P1 are held at the position shown in the drawing by this pushing force.

Numeral 13 is a semicircular roller which conveys out transfer sheets P1. When the semicircular roller 13 is rotated counterclockwise by one revolution, its circumferential surface is brought into contact with transfer sheets P1, and the uppermost transfer sheet is formed into a loop by the action of the separation claw 12, so that it is separated from the stack of transfer sheets and sent out to the first sheet feeding roller 14.

Numeral 15 is a second sheet feeding roller, and its drive force is limited by a friction clutch. Numeral 16 is a shutter member disposed on the downstream side of the second sheet feeding roller 15. The shutter member 16 is connected with solenoid S, and when solenoid S is in a state of OFF, an upper end of the shutter member 16 is projected onto a transfer sheet conveyance surface.

Numeral 20 is a manual feeding tray, numeral 21 is a manual feeding plate, and numeral 22 is a feeding roller. Transfer sheets P2 to be manually fed, are stacked on the manual feeding plate 21, and brought into pressure contact with the feeding roller 22 when the manual feeding plate 21 is rotated clockwise around a shaft 40.

When a drive roller 23 functions as a feeding roller 22, the feeding roller 22 can be omitted. In this case, the drive roller 23 is disposed to the right in the drawing, so that it comes into contact with both transfer sheet P2 and separation roller 24.

Numeral 23 is a semicircular drive roller, and numeral 24 is a separation roller which is brought into pressure contact with the circumferential surface of the drive roller 23.

The separation roller 24 is connected with a torque limiter 25 through gears G1 and G2. When torque not less than a predetermined value is applied to the separation roller 24, it is idly rotated, and when the applied torque becomes lower than that, the separation roller is stopped. This separation roller may be a stop roller which is not connected with the torque limiter and not idly rotated together with the drive roller 23.

Sheet feeding operations to feed transfer sheets P1 and P2 with the sheet feeding device of the present invention will be explained as follows.

Transfer sheet P1 sent out from the sheet feeding cassette 10 is conveyed by the first sheet feeding roller 14, and passes through a conveyance passage formed below the lower surface of the developing unit 2. Then, the transfer sheet reaches the second sheet feeding roller 15. The leading edge of transfer sheet P1 is brought into contact with the shutter member 16 by the conveyance action, and transfer sheet P1 is stopped.

When transfer paper P1 is stopped by the shutter member 16, the second sheet feeding roller 15 slips on the surface of transfer sheet P1. When solenoid S is changed over to ON in accordance with the timing of image transfer on the photoreceptor drum 1, a plunger is pulled and the shutter member 16 is withdrawn from the transfer sheet conveyance surface. Then, the second sheet feeding roller 15 starts conveying the sheet again, so that transfer sheet P1 is sent to the image transfer region.

Transfer sheet P1, fed while the aforementioned operations were being performed, pushes actuator A1 so that actuator A1 is reciprocated by one stroke in this manner: it is rotated clockwise and counterclockwise . Therefore, photosensor PS is changed over from ON to OFF, and then the conveyance of the next transfer sheet P1 is started.

When transfer paper P2 is conveyed out from the manual feed tray 20, it is fed by the feeding roller 22 from the manual feed plate 21.

Transfer paper P2 conveyed out by the feeding roller 22, is conveyed to the separation device including the drive roller 23 and the separation roller 24, and further conveyed forward by the drive roller 23 and the separation roller 24 which pinch transfer paper P2.

When one sheet of transfer paper P2 is conveyed, not less than a predetermined value of torque is transmitted from the drive roller 23 to the separation roller 24 through friction between the drive roller 23 and transfer paper P2, so that the separation roller 24 is idly rotated. However, when not less than two sheets of transfer papers P2 are conveyed, torque applied by the torque limiter overcomes a frictional force between transfer papers P2. Accordingly, the separation roller 24 is stopped and only the uppermost transfer sheet P2 is conveyed and other transfer sheets P2 are not conveyed.

After transfer paper P2 has been separated, the drive roller 23 is stopped at a position in which the circumferential surface of the drive roller 23 is disposed upward as shown in the drawing, so that the pressure contact between the drive roller 23 and the separation roller 24 is released.

In the same manner as transfer paper P1 explained before, transfer paper P2 is conveyed to the transfer section by the cooperation of the second paper feeding roller 15 and the shutter member 16.

Even when the leading edge of transfer paper P2 comes into contact with the shutter member 16 and the trailing edge has not yet passed through the separation device, transfer paper P2 can be appropriately fed by the second paper feeding roller 15 without being given excessive force by the drive roller 23 since transfer paper P2 has already been released from the paper separation device composed of the drive roller 23 and the separation roller 24.

When transfer paper P2 is fed, actuator A2 is reciprocated by one stroke counterclockwise and clockwise, so that photosensor PS is turned on and off through actuator A1. Therefore, a signal to allow the feeding operation of the next paper is displayed.

In the aforementioned example, the separation roller 24 is stopped when the number of transfer sheets P2 is not less than 2. However, the separation roller 24 may be always rotated by the rotation of the torque limiter shaft when the number of conveyed transfer papers P2 is not less than 2.

Figure 2:
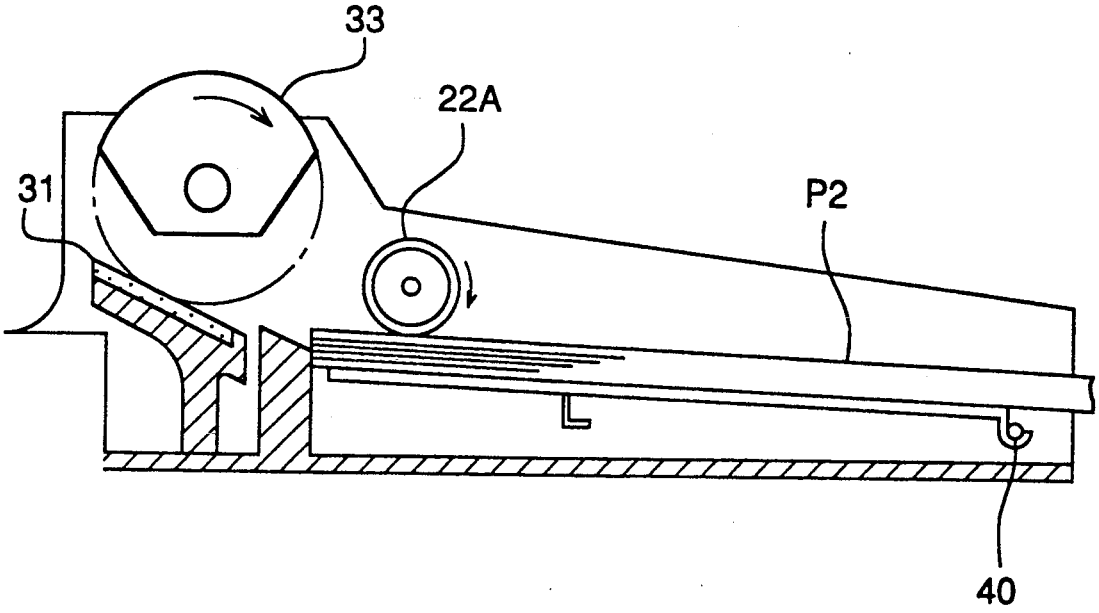
FIG. 2 is a view showing the structure of an essential portion of the sheet feeding device of the second invention.

FIG. 2 is a sectional view showing the essential portion of the paper separation device of the second example. Transfer paper P2 sent out by a feeding roller 22A is conveyed by a semicircular drive roller 33 while transfer paper P2 is rubbed with friction pad 31. The frictional force generated by the circumferential surface of the drive roller 33 is stronger than the frictional force generated by the friction pad 31. Therefore, one sheet of transfer paper P2 sent out by the drive roller 33, passes through between the drive roller 33 and the friction pad 31, and conveyed to the second paper feeding roller 15. When two sheets of transfer papers P2 are sent out by the drive roller 33, paper separating operations are performed as follows: since the frictional force between the friction pad 31 and transfer paper P2 is set stronger that that between transfer papers P2, transfer paper on the drive roller 33 side is conveyed out; and transfer paper P2 on the friction pad 31 side is blocked, so that only one sheet of transfer paper P2 is conveyed out to the second paper feeding roller 15.

In FIG. 2, the curved portion of drive roller 33 has a circumferential length that is greater than a distance between a point of contact of the sheet feeding roller 22A with the uppermost sheet of the stacked sheets and a point where said drive roller 33 contacts the pad 31 of the multi-feed prevention means, when the curved surface of drive roller 33 is rotated to be in contact with said pad 31, so that the transfer paper P2 is in contact with at least one of the feed roller 22A or the drive roller 33.

Figure 3:
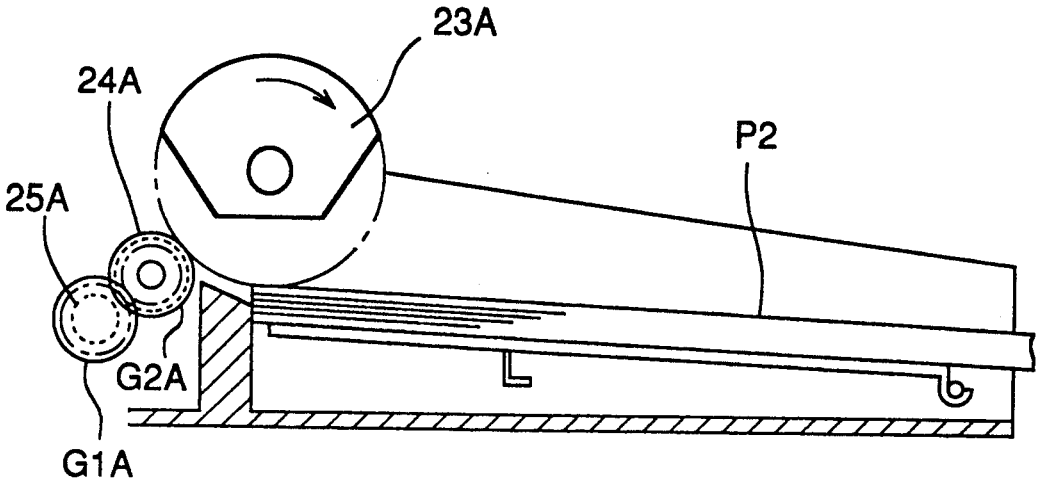
FIG. 3(*a*) is a view showing the structure of an essential portion of the sheet feeding device of another example of the first invention.
Figure 3:
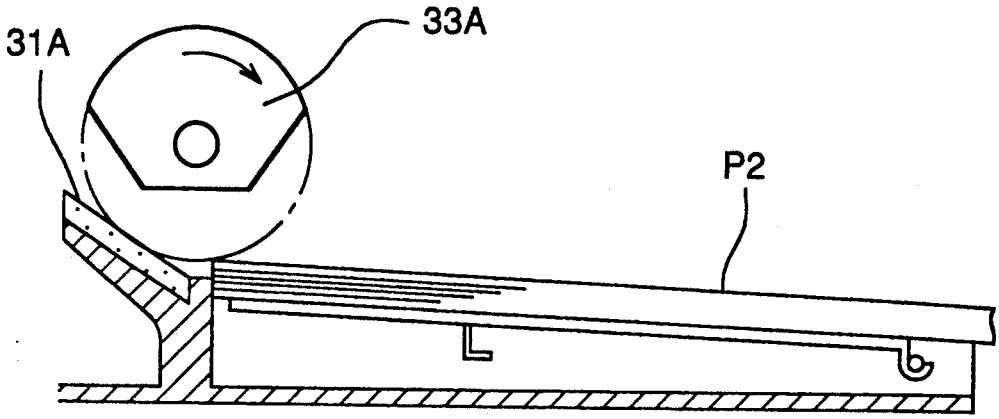

FIGS. 3(*a*) and 3(*b*) show an example in which paper feeding rollers 22 and 22A to convey the uppermost transfer sheet on the tray are omitted. An example is shown in FIG. 3(*a*) in which a semicircular drive roller 23A is brought into contact with uppermost transfer paper P2 so that it can be sent out, and at the same time, the drive roller 23A comes into contact with a separation roller 24A so that the transfer paper can be separated from others. Another example is shown in FIG. 3(*b*) in which a semicircular drive roller 33A is brought into contact with uppermost transfer paper P2 so that it can be sent out, and at the same time, the drive roller 33A comes into contact with friction pad 31A so that it can be separated from other transfer papers.

According to the present invention, even in a manual feed device to feed transfer papers, a registration system of paper feeding rollers in which a simple shutter is used, can be adopted. As a result, problems such as transfer slippage can be prevented, and manufacturing costs can be reduced.

What is claimed is:

1. A bypass sheet feeding device for feeding one by one sheets stacked in a stack on a bypass sheet tray, said feeding device comprising:

(a) a drive roller having a substantially semicircular cross section and a substantially semicircular circumferential surface for feeding an upper most sheet of the sheets stacked in said stack fed from a first feeding roller disposed on the sheets in the stack;

(b) multi-feed prevention means for preventing at least a sheet below the uppermost sheet in said stack from being conveyed by said drive roller, said multi-feed prevention means being in a press contact with the semicircular circumferential surface of said drive roller, such that the uppermost sheet in said stack is separated and then conveyed by said drive roller;

(c) a second feeding roller for feeding the uppermost sheet separated by said drive roller, from said drive roller to an image transfer region; and (d) shutter means provided near the second feeding roller for controlling a conveyance of the uppermost sheet fed by said second feeding roller; and wherein:

said second feeding roller slips on a surface of the uppermost sheet when the uppermost sheet is stopped by said shutter means; and after a separation of said uppermost sheet by said drive roller is completed, said drive roller is stopped at a position where the semicircular circumferential surface thereof is positioned so that the press contact between the semicircular circumferential surface thereof and said multi-feed prevention means is released to enable the uppermost sheet to move freely.

2. The feeding device of claim 1, wherein said multi-feed prevention means comprises a roller that is inhibited from rotating.

3. The feeding device of claim 1, wherein said multi-feed prevention means comprises;

a roller coupled to a torque limiter, said roller rotating with said drive roller when a torque greater than a predetermined value is generated; and said roller stopping a rotation thereof when a torque less than said predetermined value is generated.

4. The feeding device of claim 1, wherein said multi-feed prevention means comprises a constantly rotating roller coupled to a torque limiter such that said constantly rotating roller rotates in a direction that is opposite to a direction of rotation of said drive roller when a torque less than a predetermined value is generated.

5. The feeding device of claim 1, wherein said multi-feed prevention means comprises a friction pad that has a coefficient of friction that is less than that of the semicircular circumferential surface of said drive roller and is greater than a coefficient of friction between adjacent sheets in said stack.

6. The feeding device of claim 1, wherein a circumferential length at said semicircular cross section of said drive roller is greater than a distance between a point where said sheet feeding roller comes into contact with said uppermost sheet and a point where said drive roller comes into contact with said multi-feed prevention means.

7. A bypass sheet feeding device for feeding one by one sheets stacked in a stack on a bypass sheet tray, said feeding device comprising:

(a) a drive roller having a substantially semicircular cross section and a substantially semicircular circumferential surface for feeding an uppermost sheet of the sheets stacked in said stack on said bypass sheet tray by coming into contact with the uppermost sheet and for separating and conveying the uppermost sheet;

(b) multi-feed prevention means for preventing at least a sheet below the uppermost sheet from being conveyed by said drive roller said multi-feed prevention means being in a pressure contact with the semicircular circumferential surface of said drive roller, such that the uppermost sheet in said stack is separated and then conveyed by said drive roller;

(c) a feeding roller for feeding the uppermost sheet separated by said drive roller, from said drive roller to an image transfer region; and (d) shutter means provided near said feeding roller for controlling a conveyance of the uppermost sheet fed by said feeding roller; and wherein:

said feeding roller slips on a surface of the uppermost sheet when the uppermost sheet is stopped by said shutter means; and after a separation of said uppermost sheet is completed by said drive roller, said drive roller is stopped at a position where the semicircular circumferential surface there is positioned so that the pressure contact between the semicircular surface thereof and said multi-feed prevention means is released to enable the uppermost sheet to move freely.

8. The feeding device of claim 7, wherein said multi-feed prevention means comprises a roller that is inhibited from rotating.

9. The feeding device of claim 7, wherein:

said multi-feed prevention means comprises;

a roller coupled to a torque limiter, said roller rotating with said drive roller when a torque greater than a predetermined value is generated; and said roller stopping a rotation thereof when a torque less than said predetermined value is generated.

10. The feeding device of claim 7, wherein said multi-feed prevention means comprises a constantly rotating roller coupled to a torque limiter such that said constantly rotating roller rotates in a direction that is opposite to a direction of rotation of said drive roller when a torque less than a predetermined value is generated.

11. The feeding device of claim 7, wherein said multi-feed prevention means comprises a friction pad that has a coefficient of friction that is less than that of the semicircular circumferential surface of said drive roller and is greater than a coefficient of friction between adjacent sheets in said stack.

* * * * *